US005769716A

United States Patent [19]

Saffari et al.

[11] Patent Number: 5,769,716

[45] Date of Patent: Jun. 23, 1998

[54] SYMBOL FALL GAME METHOD AND APPARATUS

[75] Inventors: Ali Saffari, Reno; Robert Breckner, Sparks; Mark Bansemer; Evelyn Liao, both of Reno, all of Nev.

[73] Assignee: International Game Technology, Reno, Nev.

[21] Appl. No.: 720,490

[22] Filed: Sep. 30, 1996

[51] Int. Cl.[6] ..... G07F 17/34

[52] U.S. Cl. ..... 463/20; 273/143 R

[58] Field of Search ..... 273/143 R, 138.1, 273/138.2, 138 A; 463/20

[56] References Cited

U.S. PATENT DOCUMENTS

| | | | |
|---|---|---|---|
| 4,621,814 | 11/1986 | Stepan et al. | 463/46 |
| 4,660,833 | 4/1987 | Dickinson et al. | 463/20 |
| 4,837,728 | 6/1989 | Barrie et al. | 463/27 |
| 5,326,104 | 7/1994 | Pease et al. | 463/18 |

FOREIGN PATENT DOCUMENTS

| | | | |
|---|---|---|---|
| 48825/85 | 5/1986 | Australia . | |
| 2111317 | 7/1994 | Canada . | |
| 2083935 | 3/1982 | United Kingdom | 273/143 R |
| 2106293 | 4/1983 | United Kingdom | 273/138 A |
| 2 147 773 | 5/1985 | United Kingdom . | |
| 2 148 135 | 5/1985 | United Kingdom . | |

*Primary Examiner*—Benjamin H. Layno
*Attorney, Agent, or Firm*—Sheridan Ross

[57] ABSTRACT

A game which involves a player positioning sequentially-provided symbols onto a plurality of pre-defined positions is provided. In one embodiment, a plurality of columns, each with a plurality of positions is displayed, symbols are randomly presented and displayed to the user who may then select into which column to place the symbol. The symbol is placed in the lowest vacant position of the selected column and the next randomly selected symbol is presented. In one embodiment, if the user does not select the column in a predetermined time period, the column is randomly selected for the user. After some or all positions are filled, the arrangement of symbols is evaluated to determine whether any collection or alignment of symbols corresponds to pre-defined winning collection or alignment.

16 Claims, 7 Drawing Sheets

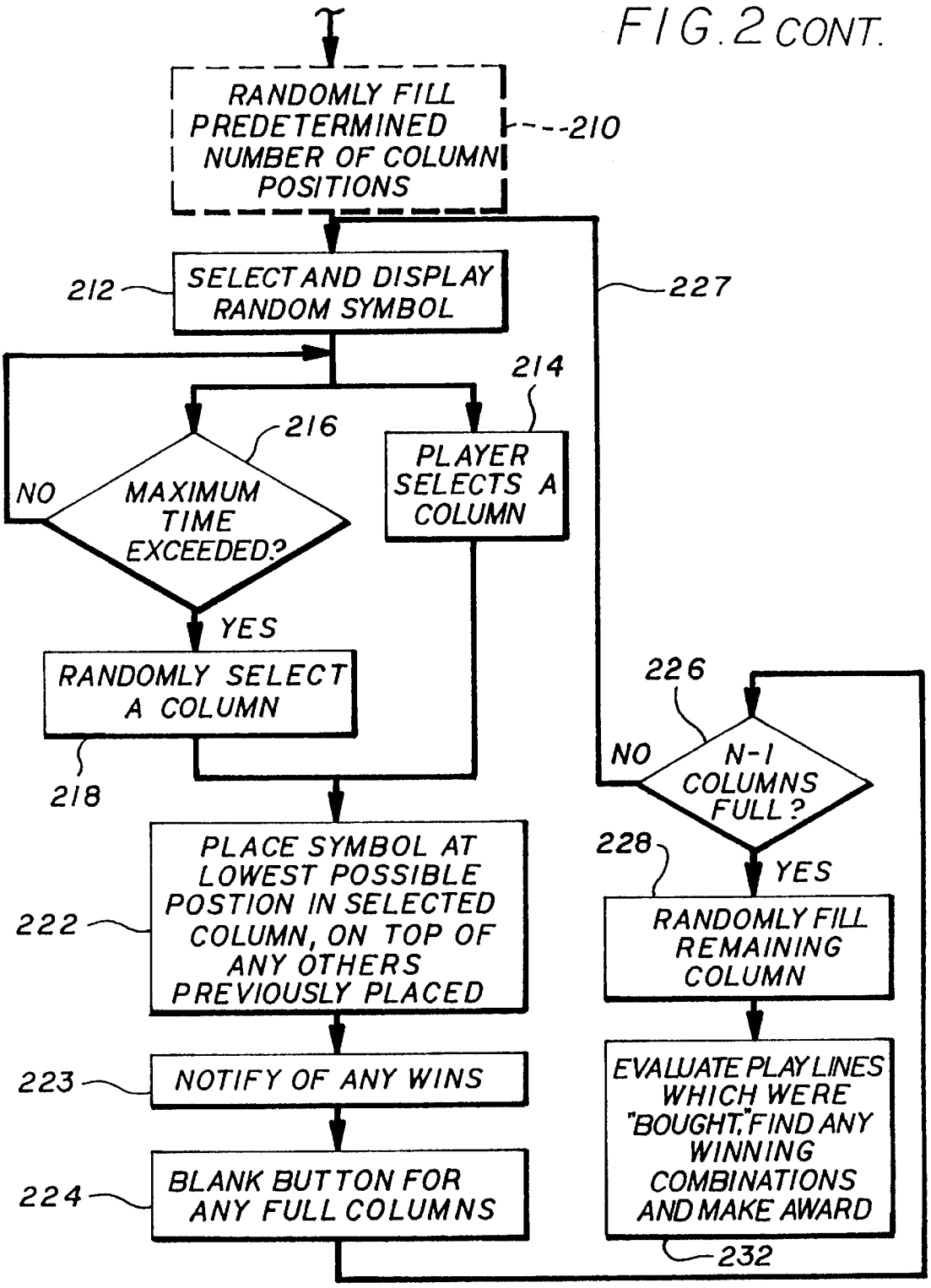
FIG. 2 CONT.
RANDOMLY FILL PREDETERMINED NUMBER OF COLUMN POSITIONS
210
SELECT AND DISPLAY RANDOM SYMBOL
212
227
214
216
NO
MAXIMUM TIME EXCEEDED?
PLAYER SELECTS A COLUMN
YES
RANDOMLY SELECT A COLUMN
218
226
NO
N-1 COLUMNS FULL?
228
YES
PLACE SYMBOL AT LOWEST POSSIBLE POSTION IN SELECTED COLUMN, ON TOP OF ANY OTHERS PREVIOUSLY PLACED
222
RANDOMLY FILL REMAINING COLUMN
223
NOTIFY OF ANY WINS
EVALUATE PLAY LINES WHICH WERE "BOUGHT," FIND ANY WINNING COMBINATIONS AND MAKE AWARD
224
BLANK BUTTON FOR ANY FULL COLUMNS
232

408
CLUSTER CONTROLLER
COMPUTER
402
406
COMMUNICATIONS
404
MEMORY
DISPLAY
INPUT
COIN/CURRENCY ACCEPTOR/HANDLER
302
322
412

SYMBOL FALL GAME METHOD AND APPARATUS

The present invention relates to a game method and apparatus and in particular to an electronic game involving positioning of symbols which are randomly displayed in sequence.

BACKGROUND INFORMATION

A number of types of games involve a degree of skill or dexterity on the part of the player. For example, some games are configured so that players who have a higher degree of skill or dexterity, such as the ability to quickly make strategic decisions, based on the present game situation, have a higher probability of success at the game than less-skilled players. Many of the most traditional games are much less dependent on the skill or dexterity of the player and are more strictly games of chance. Examples include many dice games, slot machines, lottery or keno games and the like.

In many situations it is desirable to provide games predominantly or exclusively which involve a degree of skill or dexterity. For example, in some regulatory jurisdictions such games of skill or dexterity are the only games permitted. However, it is believed that many players prefer to play games which are similar to more traditional games.

Accordingly, it would be advantageous to provide games which comply with requirements for skill and/or dexterity but which have similarities, such as visual similarities or the like, to more traditional games such as slot machine games.

SUMMARY OF THE INVENTION

The present invention provides a game which awards prizes based on the position or the alignment of symbols. In this regard, the game has some similarities to a slot machine which also awards prizes depending on the alignment of symbols. For example, when the wheels of a slot machine stop so that certain symbols are aligned in a row (such as a row of three cherry symbols, a row of three bar symbols, etc.) a prize is awarded. In the present invention, the location to which the symbols fall or move is determined at least partially by the player and thus the skill or dexterity of the player can influence the outcome of the game.

In one embodiment, the game is implemented using a video display under the control of a computer. Preferably, the video display provides for a plurality of columns, each column defining a plurality of positions for symbols. In this way, when the columns are filled with symbols, the display will bear some resemblance to the appearance of a slot machine after the wheels have all stopped. In this way, users will be able to play a game which has an appearance similar to a traditional game but which provides for a degree of skill and/or dexterity greater than that found in the traditional game.

DETAILED DESCRIPTION OF THE PREFERRED EMBODIMENTS

Figure 1:
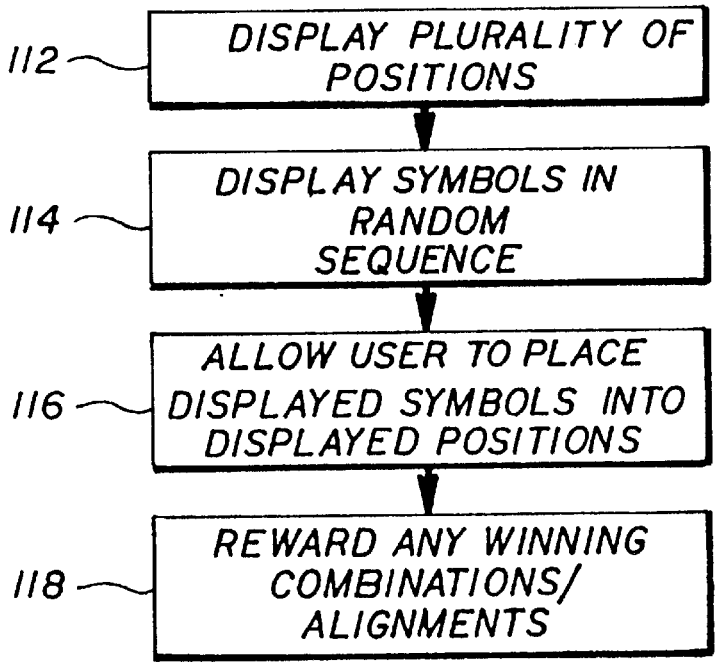
FIG. 1 is a flow chart of a game according to an embodiment of the present invention.
Figure 3A:
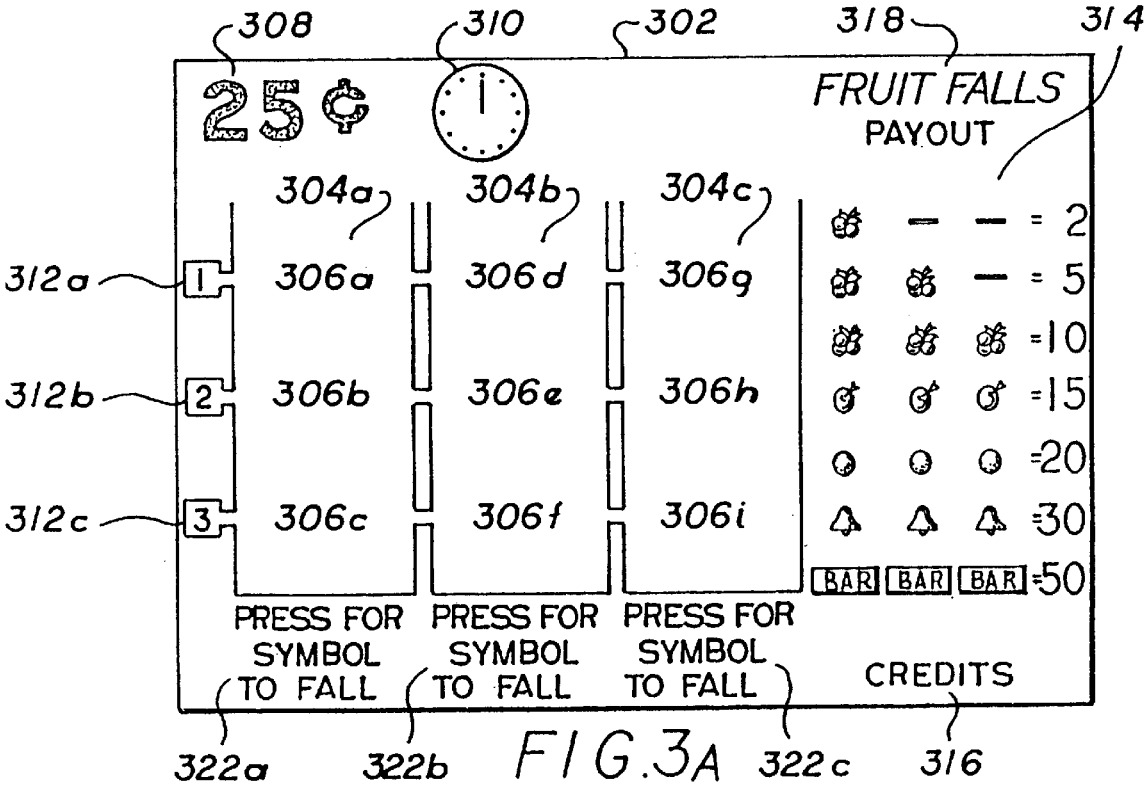
FIGS. 3A through 3F depict the appearance of a display screen at various stages of game play according to an embodiment of the present invention.

As depicted in FIG. 1, according to one process, a game involves displaying a plurality of positions, e.g., on a computer controlled display screen 112. In the embodiment depicted in FIG. 3A, the display screen 302 displays three columns 304*a*, 304*b*, 304*c*. Each column defines three vertically displaced positions 306*a* through 306*i*, which are initially shown empty or blank (FIG. 3A). Although the depicted embodiment shows positions 306*a* through 306*i* aligned in a plurality of vertical columns, it is also possible to use other arrangements of predefined positions such as in horizontal rows, diagonals, in a matrix, in a simulated three-dimensional arrangement and the like.

A number of other items may be displayed if desired. In the embodiment of FIG. 3A, the display includes an indication 308 of the denomination or minimum required wager for the game. A clock, stop watch, or other time-passing or time-expired indicator 310 may be provided to show the passage or expiration of time periods in those procedures in which the user is required to provide some input before expiration of a time period. In one embodiment, the game is won when certain combinations of symbols appear in a horizontal line and the display may include so-called "pay lines" 312*a*, 312*b*, 312*c* to visually show the user which lines will be evaluated for possible winning combinations. In one embodiment, a user may select one or more of the pay lines 312 to be potential winning pay lines, e.g., by providing a wager for each desired pay line (referred to as "buying" the pay line). If desired, the display 302 may be configured to highlight or otherwise indicate which pay lines are currently active. Although in the embodiment of FIG. 3A the pay lines 312 are shown as horizontal, other types of pay lines can also be defined such as vertical, diagonal, or convoluted.

In the depicted embodiment, a pay-out table 314 is displayed to indicate to the user which combinations of symbols will result in the award of a prize and to indicate the size of the prize which will be provided for each wining combination. If desired, an area 316 may be provided for indicating how many credits or coins have been wagered by the user on this game, or to indicate how many credits or winnings have been accumulated thus far by play on this particular apparatus. If desired, a title or name of the game 318 may be displayed. Although FIG. 3A depicts an embodiment in which the symbols are traditional slot machine symbols, including various types of fruit, bells, bars, etc., other types of symbols can be used such as numbers, astrological symbols, colors, logos and the like.

Figure 5:
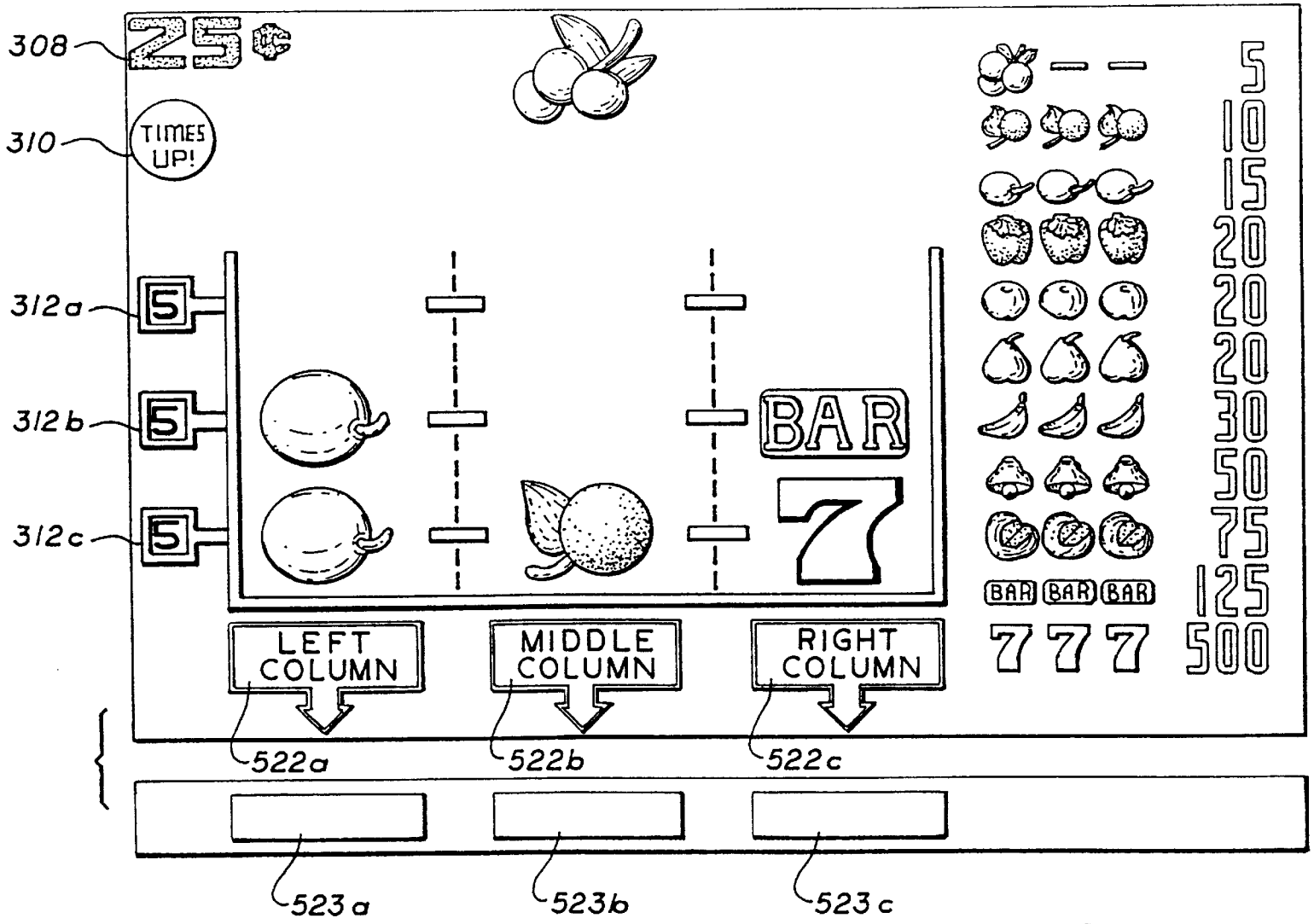
FIG. 5 depicts the appearance of a display screen during game play according to an embodiment of the present invention.

During play of the game, the display device preferably displays various symbols to the user. In one embodiment, these symbols are randomly selected 114 from among a plurality of potential symbols. If desired, the symbols which are presented to the user may be selected in a weighted or pseudo-random fashion in order to provide the desired or required odds of winning. The user is permitted to provide input to the apparatus which will result in the displayed symbol being positioned 116 at one of the positions 306. Many types of input devices can be used including a button panel, keyboard, joystick, touch screen button panel, mouse and the like. In one embodiment, touch screen input is provided such that the user may select one of the three columns 304 by pushing on a corresponding touch-sensitive region of the screen 322a, 322b, 322c. In another embodiment depicted in FIG. 5, the display includes indicia 522*a*, 522*b*, 522*c*, which point to buttons of a button panel 523*a*, 523*b*, 523*c*. After some or all of the positions are filled, the system evaluates the results and awards any prizes for any winning combinations or alignments 118.

Figure 4:
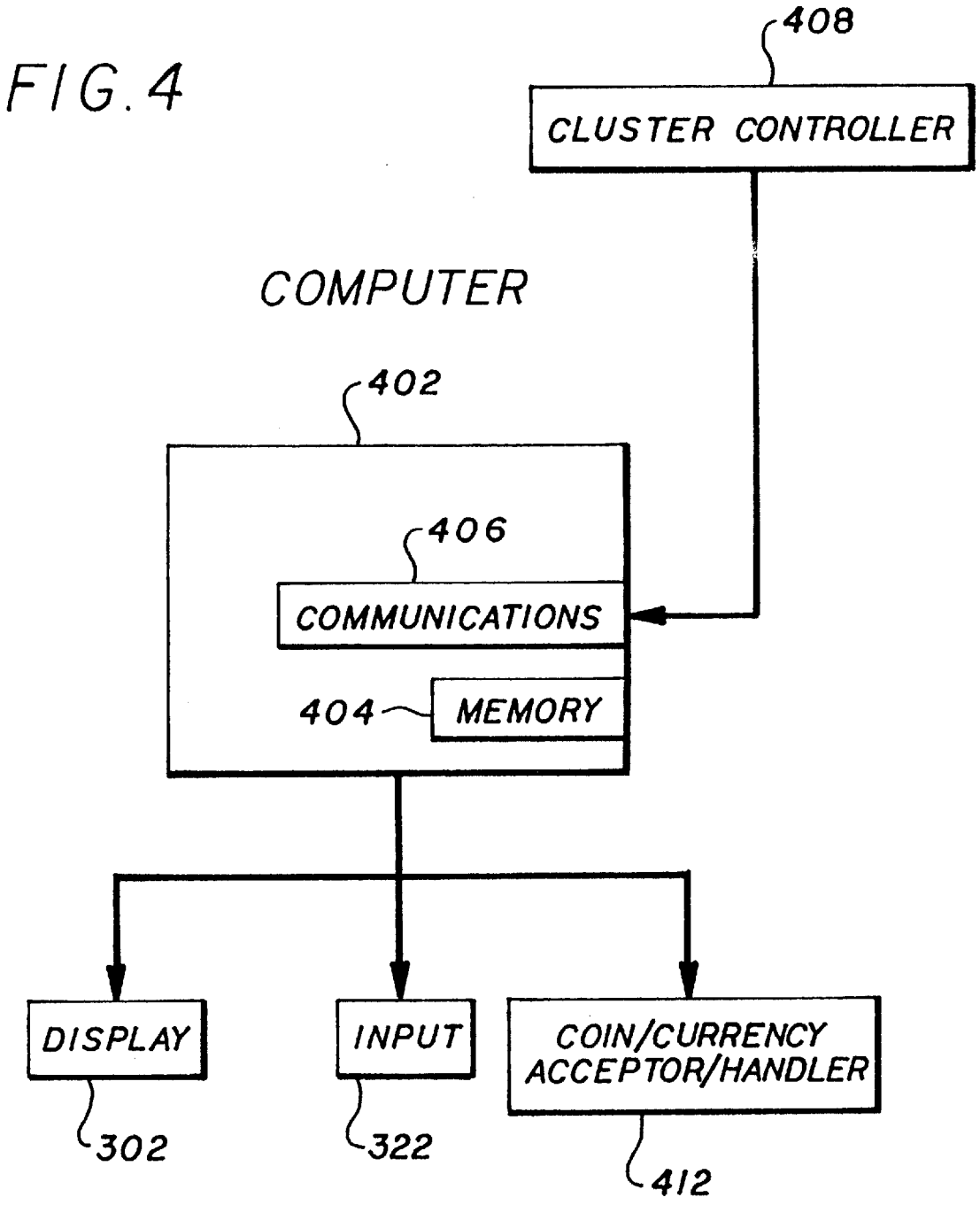
FIG. 4 is a block diagram of an apparatus for use in connection with the present invention according to one embodiment.

FIG. 4 depicts one type of apparatus on which the present invention may be implemented. In the embodiment of FIG. 4, the display device 302 and input 322 are coupled to a computer 402. Preferably, the computer 402 is also coupled to a coin or currency acceptor/handler 404, e.g., for accepting wagers and/or dispensing prizes. In one embodiment, the game procedure is implemented by controlling the computer 402 in accordance with program instructions stored in memory 404, preferably non-volatile memory. If desired, a communications device 406 such as a modem, network card, etc., may be provided for communicating with a second computer such as a cluster controller 408 which may be provided for controlling a plurality of gaming computers (not shown). The cluster controller 408 may communicate with numerous gaming computers, e.g., on a local area network, e.g., for providing for accounting, security, maintenance, and similar functions.

Figure 2:
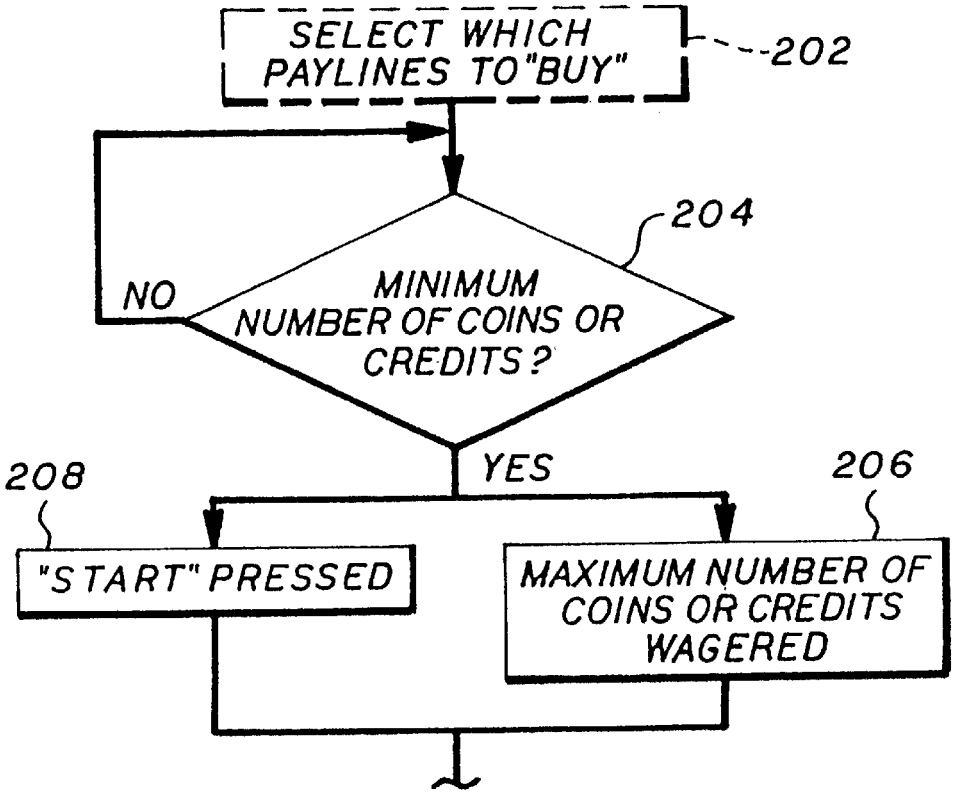
FIG. 2 is a flow chart of a game procedure according to an embodiment of the present invention.

FIG. 2 depicts a procedure for playing the game, according to one embodiment, in somewhat greater detail. As described above, if desired, the device may be configured to allow the user to select which of the pay lines 312 to buy 202. Preferably the display highlights or otherwise indicates the purchased pay lines. In other embodiments it may be desired to provide a fixed number of pay lines and require a fixed minimum wager with regard to those pay lines. In any case, the device will remain idle until a minimum wager or number of coins has been deposited 204, e.g., via coin or currency acceptor 412. Although the present invention is described in terms of coin wagers, it is also possible to provide for playing games in response to wagering credits, tokens, and the like. If desired, wagers may be made by electronic means, such as using encoded cards.

Once the minimum of coins is inserted, the game will commence once the user has either pressed the start button 208, indicating that the user does not wish to increase the wager, or after the maximum of coins or credits has been wagered for this game 206. In one embodiment, it may be desired to begin the game by filling some of the column positions 306 randomly, i.e., without needing any input from the user 210. This feature is optional, but may help preserve some of the visual appearance of a traditional slot machine or other game and may also be useful in balancing the amount of randomness or chance with the player's skill in determining outcome of the game.

Figure 3B:
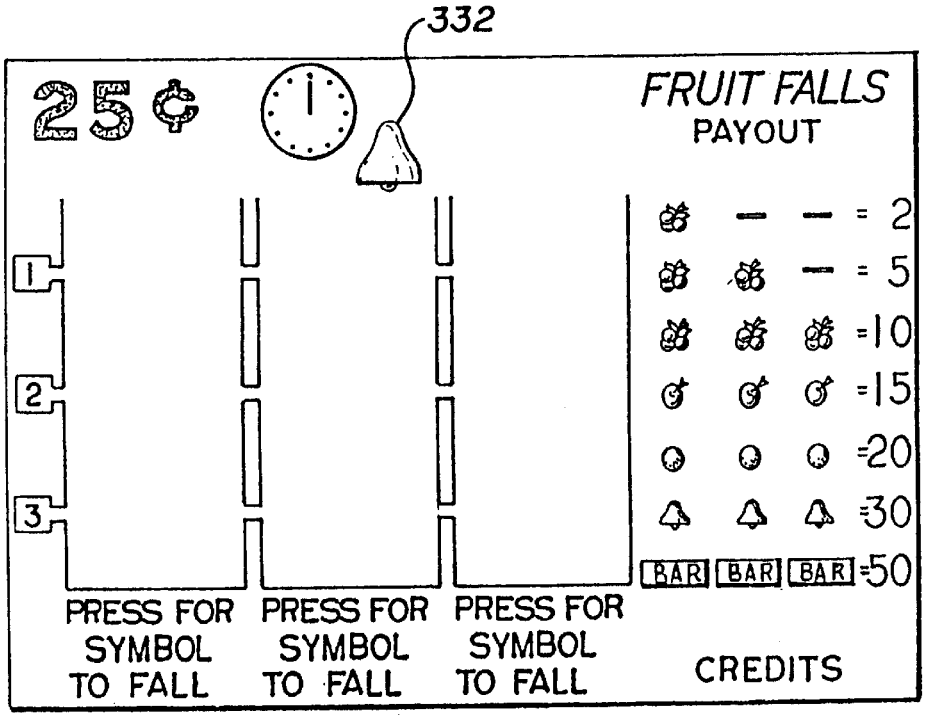

At some point before all columns are filled, the device will select and display one of the symbols, e.g., as depicted in FIG. 3B 332. The symbol displayed may be selected randomly or pseudo randomly as described above. In one embodiment, the symbol to be displayed is selected using a virtual map. A virtual map may consist of indicators, stored in memory, corresponding to different symbols that may be used in the game. For example, the virtual map may include a table or list of the indicia corresponding to the various symbols. If desired, indicia corresponding to one or more of the symbols may occur a plurality of times in the list so that as symbols are (randomly or psuedo randomly) selected from the list (or, equivalently, if the list is randomly ordered or shuffled for each game) providing multiple entries corresponding to a given symbol will effectively weight the selection corresponding to the number of times the indicium corresponding to that symbol occurs in the list. Preferably, the system is configured so that, once a symbol is drawn from the list for display on the screen, the corresponding indicium is marked or removed from the list so that that particular indicium will not be used again during this round or game (although an identical copy of the indicium may be drawn, if it occurs at another position in the list). This system has an affect somewhat analagous to using a deck of cards where each card has one of the symbols and a given symbol may occur on more than one card and where, once a card is drawn, it cannot be drawn again until the deck is reshuffled. It is also possible to configure a system in which the same position could be drawn multiple times throughout the game.

In one embodiment, the user is then given a certain maximum amount of time within which to select which of the columns to position the displayed symbol 332. If desired, the clock symbol 310 may be activated to notify the player of the remaining time. If the player does not make a valid selection within the allotted time 216, the procedure randomly selects one of the columns 304. In one embodiment, the user is permitted to select or adjust the length of the allotted time, preferably within a predetermined range. In one embodiment, the system is configured to permit disabling the time limit completely, i.e., so that the only way to position a symbol 332 in a column is by selection of a column by the user.

Figure 3C:
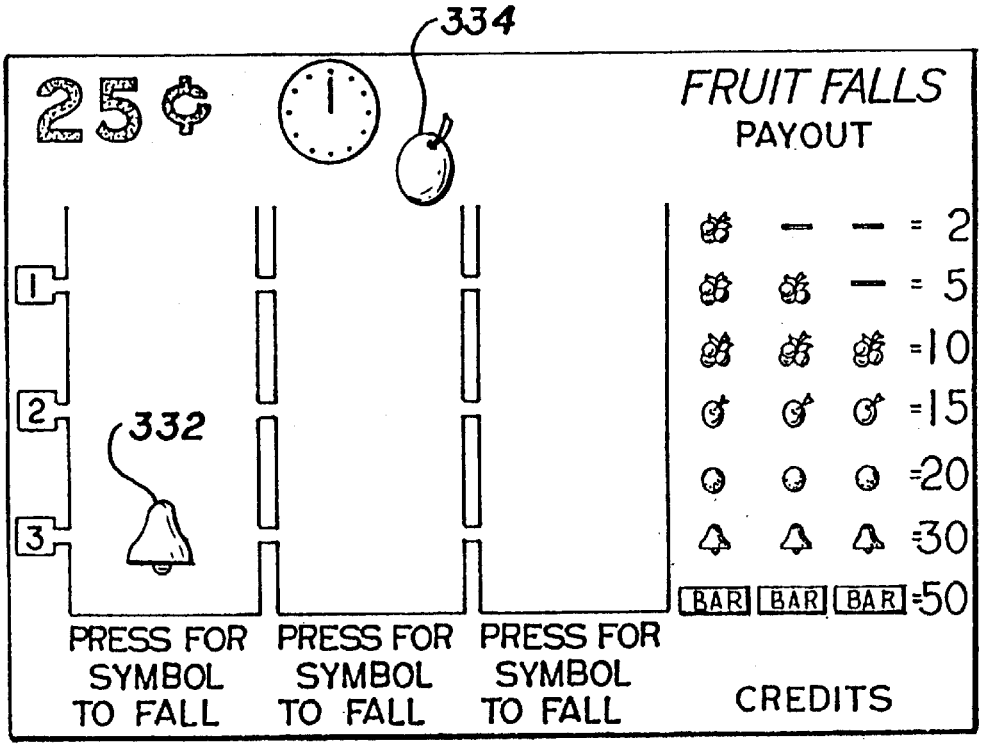

Regardless of whether a column is selected randomly 218 or by a player 214, the displayed symbol 332 is placed into that column e.g., in the lower-most possible position. For example, if, in response to the display of FIG. 3B, the left most column was selected, symbol 332 would be positioned as shown in FIG. 3C at location 306*c*. In the depicted embodiment, a symbol always falls to the lowest unoccupied position of the selected column. Since none of the positions of the first column 304*a* were occupied in the configuration of FIG. 3B, the displayed symbol 332 is moved to the lowest position 306*c* of the first column 304*a* as shown in FIG. 3C. If the newly placed symbol results in one of the columns being completely filled, it may be desired to blank-out or deintensify the touch screen legend 332 for that column so that the user is then permitted to select only from the "active" remaining columns 224. In another embodiment, it may be desired to evaluate the game for the occurrence of any winning combination after each symbol placement 223, rather than waiting for all positions to be filled before conducting such evaluation. This procedure can be useful, e.g., to reassure the user that a winning combination has been recognized, even while the user is continuing to play the game (in order to try to obtain additional winning combinations on other pay lines). Furthermore, if there is no possibility of additional winning combinations (e.g., if a user has won a maximum "progressive" prize, or if the only remaining pay lines to be filled are those which have not been "bought" by the user) it may be desirable to proceed with evaluating wins rather than force the player to continue to play a "useless" game.

In one embodiment, evaluation of wins is postponed until all positions 306*a* through 306*i* have been filled.

Figure 3D:
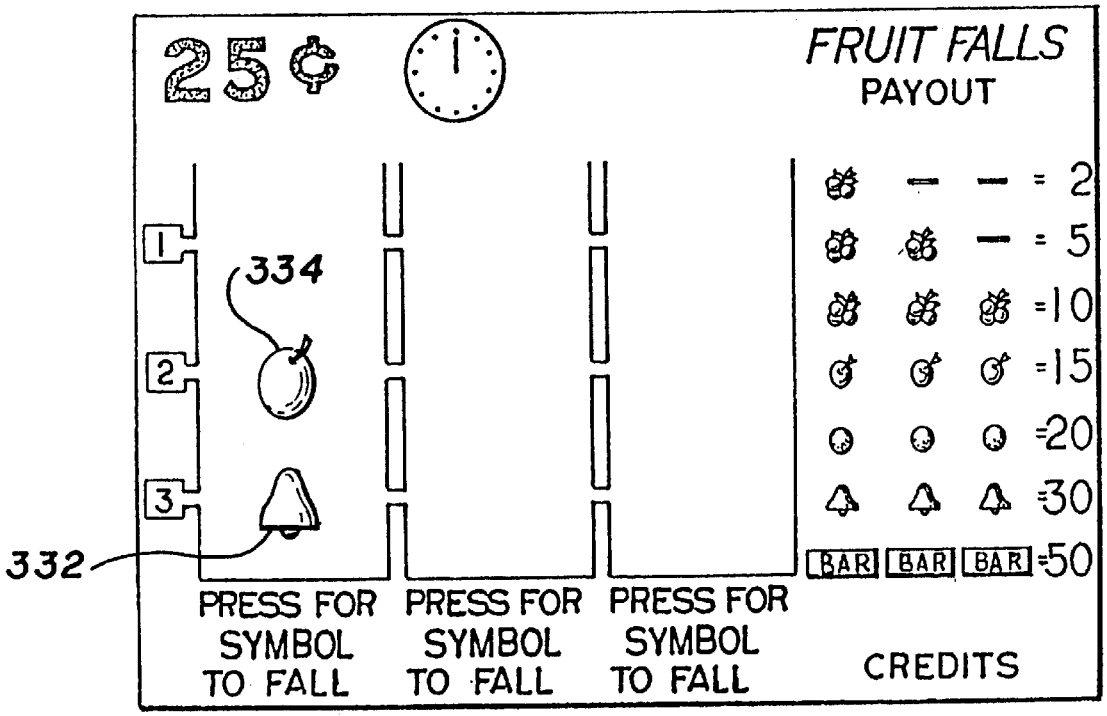

In the embodiment of FIG. 2, it is determined whether all but one of the columns have been filled 226, i.e., if there are N columns, it is determined if there are N-1 filled columns. If so, then the user has no choices as to which column to select for the next symbols and accordingly in one embodiment, the game will then randomly fill the remaining column 228. If fewer than N-1 columns are full, i.e., if the user still has choices to be made in the game, the procedure loops 227 to display another random symbol and the game continues. For example, after symbol 332 is positioned as described above, the next symbol is randomly selected and displayed 334 (FIG. 3C). If the user again selects the first column 304*a*, the new symbol 334 will be positioned in the first column and the lowest available or open position which is now position 306b as shown in FIG. 3D (since the lower-most position 306*c* is already occupied by the first symbol 332).

Figure 3E:
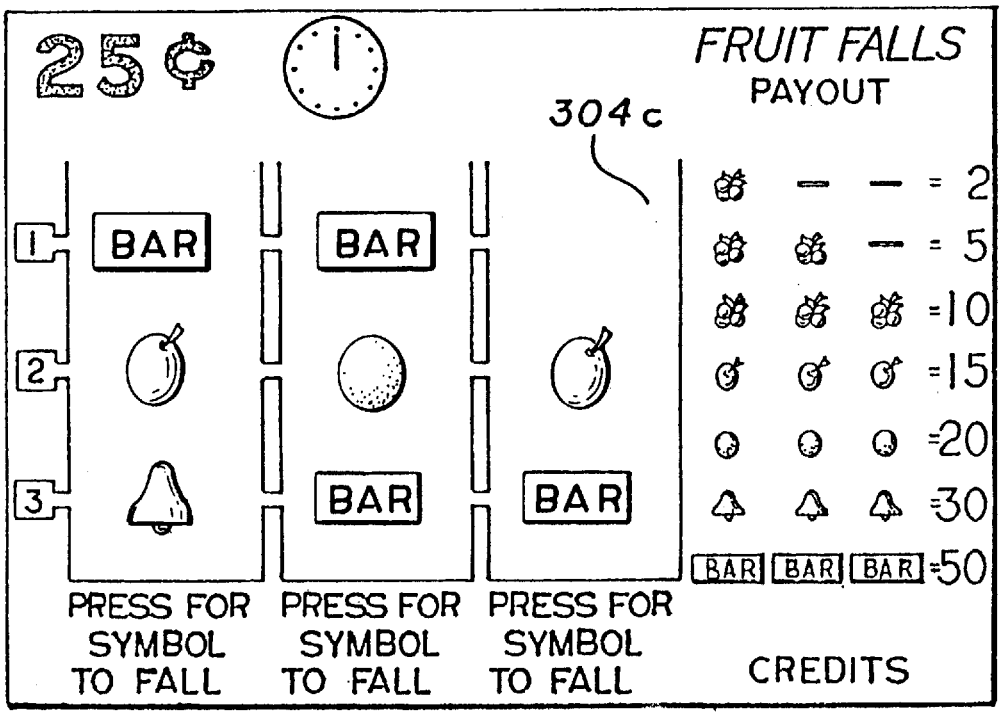
Figure 3F:
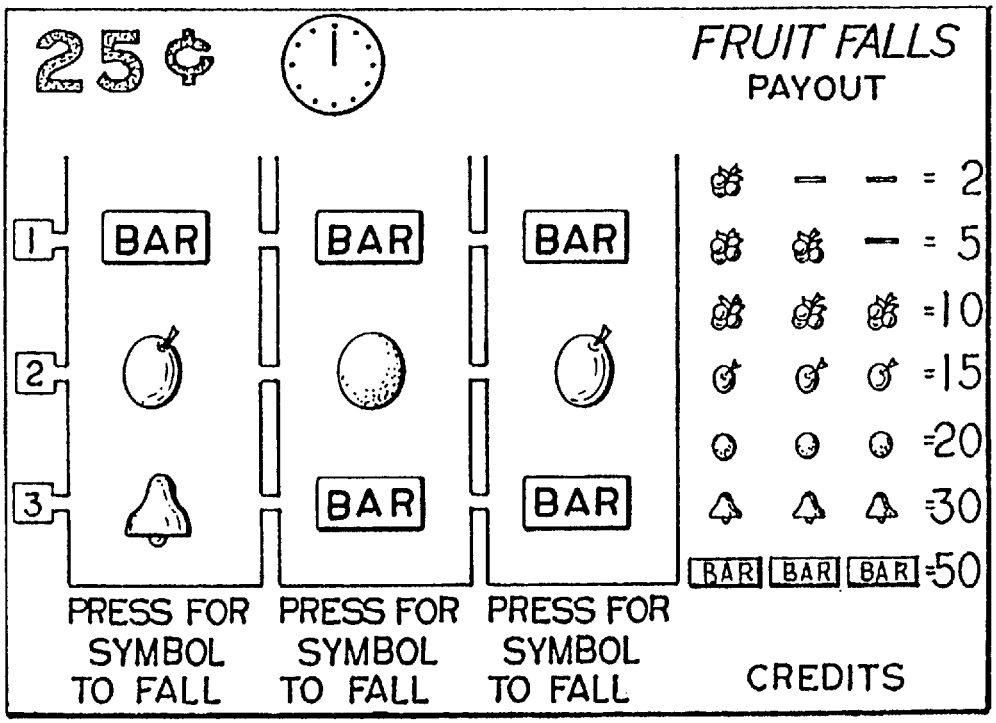

Play proceeds as described, filling columns from the bottom up until all but one column is filled, as depicted in FIG. 3E whereupon the final column will be randomly filled as shown in FIG. 3F. As can be seen, the final configuration as depicted in FIG. 3F bears some resemblance to the appearance of a slot machine at the end of slot machine game. The present invention provides a game which also involves skill or dexterity, e.g., the skill involved in selecting which column 304 plays a displayed symbol N and/or dexterity in making the selection in the allotted time.

In light of the above description, the number of advantages of the present invention can be seen. The invention can be readily implemented without requiring extensive addition of hardware, and is preferably implemented by providing program instructions in a memory as described above. Accordingly, the present invention can make use of current designs for security, accounting, maintenance and the like so that the new game can be implemented without requiring extensive redesign of such systems.

A number of variations and modifications of the invention can also be used. Although three pay lines are illustrated, more or fewer pay lines can be provided. Symbols, title or the theme of the game may be different from that illustrated. In addition or alternatively to allowing any user to select one or more pay lines to "buy,"the user may be provided with the option of buying all lines or buying a single predetermined line. The game may be provided with more or fewer positions and/or columns than that illustrated. Although the present invention has been described as being implemented in a computer-controlled video mode, other apparatus can also be provided. For example, the game may be implemented by hardwired logic, ASIC's or other nonprogrammable logic devices. The game may be implemented mechanically rather than electronically such as for providing symbol tokens which are mechanically output randomly from a chute and diverted into columns, manually, by the player, such as providing movable doors into each column.

Although the application has been described by way of a preferred embodiment and certain variations and modifications, other variations and modifications can also be used, the invention being defined by the following claims.

What is claimed is:

1. A computer-implemented process for playing a game by a user to achieve a game outcome, the computer having a memory and coupled to at least a first user input device, the method comprising:

storing, in memory, an indication of symbol alignments that are winning alignments;

displaying, on a display device coupled to said computer, a game region defining a plurality of positions in a plurality of vertical columns, including initially displaying a plurality of unoccupied positions in each of said vertical columns wherein no symbols are displayed in the unoccupied positions;

displaying at least a first symbol on said display device wherein said first symbol is initially displayed in an area remote from any of said plurality of positions;

controlling said display device to move said symbol to one of said plurality of positions, said one position being a lowermost unoccupied position in a column selected using the status of said user input device;

positioning a plurality of symbols over at least some of said plurality of positions;

outputting an indication of a win if an alignment of symbols corresponds to a winning alignment; and wherein the skill with which said user provides input via said user input device affects the outcome of the game.

2. A process, as claimed in claim 1, wherein said game region is configured to have an appearance on said display device similar to a traditional game.

3. A process, as claimed in claim 2, wherein said traditional game is a slot-machine game.

4. A process, as claimed in claim 1 wherein said plurality of positions are located in a plurality of vertical columns.

5. A process, as claimed in claim 1, wherein said step of positioning is performed only if said status of said user input device indicates that said user has used said user input device.

6. A process, as claimed in claim 1, wherein, following display of a symbol, said computer positions said symbol over a randomly-selected unoccupied position if said user does not provide input within a predetermined period.

7. A process, as claimed in claim 1, wherein said predetermined period may be selected by said user.

8. A process, as claimed in claim 1, wherein at least some symbols are moved over a position which is randomly selected by the computer independently of any input from said user.

9. A process, as claimed in claim 1, wherein said position is randomly selected.

10. A process, as claimed in claim 1, wherein said plurality of positions define a plurality of pay lines and wherein symbols aligned along any one of said pay lines are eligible as winning alignments only if said user has selected at least said one pay line.

11. A computer-implemented process for playing a game by a user to achieve a game outcome, the computer having a memory, the method comprising:

a) storing, in memory, an indication of symbol alignments that are winning alignments;

b) displaying, on a display device coupled to said computer, a game region defining a plurality of positions wherein said plurality of positions define a plurality of pay lines and a plurality of vertical columns in order to have an appearance similar to a slot-machine game, initially displaying a plurality of unoccupied positions in each of the vertical columns wherein no symbols are displayed in the unoccupied positions and storing an indication of selected pay lines in response to first user input;

c) displaying at least a first symbol on said display device wherein said first symbol is initially displayed in an area remote from any of said plurality of positions;

d) controlling said display device to move said symbol to one of said plurality of positions, said one position being a lowermost unoccupied position in a column selected using second input from said user, if said second input is provided within a predetermined period, and wherein otherwise said computer positions said symbol in the lowermost unoccupied position of a randomlyselected non-full column;

e) repeating steps c and d until one fewer than said first number of columns has all positions occupied by a symbol;

f) placing randomly selected symbols in remaining non-filled positions;

g) outputting an indication of a win if an alignment of symbols corresponds to a winning alignment wherein symbols aligned along any one of said pay lines are eligible as winning alignments only if said user has selected at least said one pay line by said first input.

12. A process, as claimed in claim 11, wherein at least some symbols are moved over a position which is randomly selected by the computer independently of any input from said user.

13. A process, as claimed in claim 11, wherein said first input is permitted only if said user has deposited a first wager.

14. A process, as claimed in claim 11, wherein said second input is provided using a button panel.

15. A process, as claimed in claim 11, wherein said second input is provided using a touch screen input device.

16. Apparatus for playing a game by a user to achieve a game outcome using a computer, the apparatus comprising:

memory, coupled to said computer, for storing at least an indication of symbol alignments that are winning alignments;

a display device, coupled to said computer, and controlled by said computer to display a game region defining a plurality of positions in a plurality of vertical columns, said display controlled to initially display a plurality of unoccupied positions in each of said vertical columns wherein no symbols are displayed in the unoccupied positions;

means for controlling said display device to display at least a first symbol on said display device wherein first symbol is initially displayed in an area remote from any of said plurality of positions;

means for controlling said display device to move said symbol to one of said plurality of positions, said one position being a lowermost unoccupied position in a column selected using input from said user;

means for controlling said display device to position a plurality of symbols over at least some of said plurality of positions;

means for outputting an indication of a win if an alignment of symbols corresponds to a winning alignment; and wherein the skill with which said user provides said input affects the outcome of the game.

* * * * *